US008801134B2

(12) United States Patent
Bledsoe et al.

(10) Patent No.: US 8,801,134 B2
(45) **Date of Patent: *Aug. 12, 2014**

(54) DETERMINING POSITIONING OF A HANDHELD IMAGE TRANSLATION DEVICE USING MULTIPLE SENSORS

(75) Inventors: James Bledsoe, Corvallis, OR (US); James Mealy, Corvallis, OR (US); Asher Simmons, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 13/562,023

(22) Filed: Jul. 30, 2012

(65) Prior Publication Data

US 2012/0293580 A1 Nov. 22, 2012

Related U.S. Application Data

(63) Continuation of application No. 12/036,996, filed on Feb. 25, 2008, now Pat. No. 8,240,801.

(60) Provisional application No. 60/891,328, filed on Feb. 23, 2007.

(51) Int. Cl.
*B41J 29/38* (2006.01)

(52) U.S. Cl.
USPC ..... 347/14; 347/19; 347/109

(58) Field of Classification Search
USPC ..... 347/7, 14, 15, 19, 22, 23, 29, 35, 36, 347/37, 40–43, 89, 90, 109
See application file for complete search history.

(56) References Cited

U.S. PATENT DOCUMENTS

| | | | |
|---|---|---|---|
| 5,578,813 | A | 11/1996 | Allen et al. |
| 5,927,872 | A | 7/1999 | Yamada |
| 5,988,900 | A | 11/1999 | Bobry |
| 6,357,939 | B1 | 3/2002 | Baron |
| 7,607,749 | B2 | 10/2009 | Tabata et al. |
| 7,661,814 | B2 | 2/2010 | Noe et al. |
| 7,845,748 | B2 | 12/2010 | Mealy et al. |
| 7,949,370 | B1 | 5/2011 | Bledsoe et al. |
| 8,000,740 | B1 | 8/2011 | Bledsoe et al. |
| 8,077,343 | B1 | 12/2011 | Simmons et al. |
| 8,107,108 | B1 | 1/2012 | McKinley et al. |
| 8,223,384 | B1 | 7/2012 | Bledsoe et al. |
| 8,226,194 | B1 | 7/2012 | Bledsoe et al. |
| 8,339,675 | B2 | 12/2012 | Mealy et al. |
| 8,342,627 | B1 | 1/2013 | Bledsoe et al. |

(Continued)

FOREIGN PATENT DOCUMENTS

| | | |
|---|---|---|
| JP | 2002307756 | 10/2002 |
| JP | 2006341604 | 12/2006 |

OTHER PUBLICATIONS

U.S. Appl. No. 11/955,258, filed Dec. 12, 2007, "Printer for a Mobile Device", Simmons et al., 30 pages.

(Continued)

*Primary Examiner* — Thinh Nguyen

(57) ABSTRACT

Systems, apparatuses, and methods for a handheld image translation device are described herein. The handheld image translation device may include a position module to determine positioning information including both translation and rotation information based at least in part on captured navigational measurements. A print module of the handheld image translation device may cause print forming substances to be deposited based at least in part on the positioning information. Other embodiments may be described and claimed.

20 Claims, 7 Drawing Sheets

(56) References Cited

U.S. PATENT DOCUMENTS

| | | | |
|---|---|---|---|
| 2003/0043388 | A1 | 3/2003 | Andrews et al. |
| 2004/0109034 | A1 | 6/2004 | Brouhon |
| 2006/0050131 | A1 | 3/2006 | Breton |
| 2006/0279784 | A1 | 12/2006 | Carlson et al. |
| 2008/0204770 | A1 | 8/2008 | Bledsoe et al. |
| 2008/0212120 | A1 | 9/2008 | Mealy et al. |

OTHER PUBLICATIONS

U.S. Appl. No. 11/972,462, filed Jan. 10, 2008, "Usage Maps in Image Deposition Devices", Simmons et al., 32 pages.
U.S. Appl. No. 12/016,833, filed Jan. 18, 2008, "Sensor Positioning in Handheld Image Translation Device", Simmons et al. 31 pages.
U.S. Appl. No. 12/062,472, filed Apr. 3, 2008, "Image Translation Device Providing Navigational Data Feedback to Communication Deivice", McKinley et al., 32 pages.
U.S. Appl. No. 12/188,056, filed Aug. 7, 2008, "Controlling a Plurality of Nozzles of a Handheld Printer", Mealy et al., 40 pages.
The Japanese Office Action mailed Jun. 28, 2011 for Japanese patent application No. 2009-551060, a counterpart foreign application of U.S. Appl. No. 12/036,996.

DETERMINING POSITIONING OF A HANDHELD IMAGE TRANSLATION DEVICE USING MULTIPLE SENSORS

CROSS-REFERENCES TO RELATED APPLICATIONS

This present application is a continuation of, and claims priority to, U.S. patent application Ser. No. 12/036,996, filed on Feb. 25, 2008, entitled "Determining Positioning of a Handheld Image Translation Device," which is a non-provisional application of provisional application 60/891,328, filed on Feb. 23, 2007, and claims priority to said provisional application. The specification of said provisional application is hereby incorporated in its entirety, except for those sections, if any, that are inconsistent with this specification.

TECHNICAL FIELD

Embodiments of the present invention relate to the field of image translation and, in particular, to determining positioning of a handheld image translation device.

BACKGROUND

Traditional printing devices rely on a mechanically operated carriage to transport a print head in a linear direction as other mechanics advance a medium in an orthogonal direction. As the print head moves over the medium an image may be laid down. Portable printers have been developed through technologies that reduce the size of the operating mechanics. However, the principles of providing relative movement between the print head and medium remain the same as traditional printing devices. Accordingly, these mechanics limit the reduction of size of the printer as well as the material that may be used as the medium.

Handheld printing devices have been developed that ostensibly allow an operator to manipulate a handheld device over a medium in order to print an image onto the medium. However, these devices are challenged by the unpredictable and nonlinear movement of the device by the operator. The variations of operator movement, including rotation of the device itself, make it difficult to determine the precise location of the print head. This type of positioning error may have deleterious effects of the quality of the printed image.

Certain handheld scanners have been developed for acquiring an image from a target media. During a scan, image data is recorded by image sensors along with positioning data by positioning sensors, which bracket the image sensors. The accumulated image data is position-tagged and recorded as distorted image data. Once the distorted image data has been acquired, it will be processed to provide a rectified image that corrects for rotational distortions. This rectification process further relies on overlapping regions of acquired image data to facilitate the stitching of the final image.

While this process may work in a scanning scenario, a printing scenario presents other challenges. For example, in a printing operation the positioning of a handheld printing device may not be postponed until after a medium has been fully scanned. Furthermore, stitching of a captured image may also not be available.

SUMMARY

At least some embodiments of the present invention are based on the technical problem of providing a handheld image translation device that may accurately determine a position, including translation and rotation, of the device during a printing operation. More specifically, there is provided, in accordance with various embodiments of the present invention, a control block of a handheld image translation device that includes a communication interface configured to receive an image from an image source; a position module configured to control first and second navigation sensors to respectively capture a plurality of first navigational measurements and a plurality of second navigational measurements, to determine a translation of the device relative to a reference location based at least in part on the plurality of first navigational measurements, and to determine a rotation of the device based at least in part on the plurality of first navigational measurements and the plurality of second navigational measurements; and a print module configured to cause a printing substance to be deposited on the medium based at least in part on the image, the determined translation of the device, and the determined rotation of the device.

In some embodiments, the position module is further configured to accumulate first incremental translational changes between successive navigational measurements of the plurality of first navigational measurements, and to accumulate second incremental translational changes among successive navigational measurements of the plurality of second navigational measurements. The rotation of the device may be based at least in part on a comparison of the accumulated first incremental translational changes and the accumulated second incremental translational changes.

In some embodiments, the incremental translational changes comprise changes in a first coordinate value, e.g., an x-value on a Cartesian coordinate system, and/or changes in a second coordinate value, e.g., a y-value.

In some embodiments, the position module is further configured to determine a position of a print head based at least in part on the determined translation and rotation of the device; and the print module is further configured to cause the printing substance to be deposited on the medium based at least in part on the determined position of the print head.

In some embodiments, the position module is further configured to establish a reference location based at least in part on proximity of the device to the medium.

An image translation device is also disclosed in accordance with various embodiments. The image translation device may include a print head having a plurality of nozzles; first and second navigational sensors; and a control block having a communication interface configured to receive an image from an image source; a position module configured to control the first and second navigation sensors to respectively capture a plurality of first navigational measurements and a plurality of second navigational measurements, to determine a translation of the device relative to a reference location based at least in part on the plurality of first navigational measurements, and to determine a rotation of the device based at least in part on the plurality of first navigational measurements and the plurality of second navigational measurements; and a print module configured to control the print head in a manner to deposit printing substance on the medium through selected nozzles of the plurality of nozzles based at least in part on the image received by the communication interface, the determined translation of the device, and the determined rotation of the device.

In some embodiments, the position module of the image translation device is further configured to accumulate first incremental translational changes between successive navigational measurements of the plurality of first navigational measurements, and to accumulate second incremental translational changes among successive navigational measurements of the plurality of second navigational measurements.

In some embodiments, the position module of the image translation device is further configured to determine the rotation of the device based at least in part on a comparison of the accumulated first incremental translational changes and the accumulated second incremental translational changes.

In some embodiments, the first and second incremental translational changes comprise changes in a first coordinate value and/or changes in a second coordinate value.

In some embodiments, the position module of the image translation device is further configured to determine a position of the print head based at least in part on the determined translation and rotation of the device.

In some embodiments, the position module of the image translation device is further configured to establish a reference location based at least in part on proximity of the device to the medium.

In some embodiments, the first and second navigation sensors of the image translation device are arranged on a first side of the print head.

A method for printing with a handheld image translation device is also disclosed in accordance with various embodiments of the present invention. The method may include receiving an image from an image source; capturing a plurality of first navigational measurements and a plurality of second navigational measurements; determining a translation of an device relative to a reference location based at least in part on the plurality of first navigational measurements; determining a rotation of the device based at least in part on the plurality of first navigational measurements and the plurality of second navigational measurements; and depositing a printing substance on a medium based at least in part on the received image, the determined translation, and the determined rotation.

Determining the rotation may include accumulating first incremental translational changes between successive navigational measurements of the plurality of first navigational measurements; and accumulating second incremental translational changes between successive navigational measurements of the plurality of second navigational measurements. It may also include comparing the first accumulated incremental translational changes to the second accumulated incremental translational changes.

A machine-accessible medium having associated instructions is also disclosed in accordance with embodiments of the present invention. The associated instructions, when executed, may result in an image translation device receiving an image from an image source; capturing a plurality of first navigational measurements and a plurality of second navigational measurements; determining a translation of the device relative to a reference location based at least in part on the plurality of first navigational measurements; determining a rotation of the device based at least in part on the plurality of first navigational measurements and the plurality of second navigational measurements; and depositing a printing substance on a medium based at least in part on the received image, the determined translation, and the determined rotation.

In some embodiments, the associated instructions, when executed, further results in the image translation device determining its rotation by accumulating first incremental translational changes between successive navigational measurements of the plurality of first navigational measurements; accumulating second incremental translational changes between successive navigational measurements of the plurality of second navigational measurements; and comparing the first accumulated incremental translational changes to the second accumulated incremental translational changes.

Another handheld image translation device is disclosed in accordance with further embodiments. The handheld image translation device may include means for receiving an image from an image source; means for capturing a plurality of first navigational measurements and a plurality of second navigational measurements; means for determining a translation of an device relative to a reference location based at least in part on the plurality of first navigational measurements; means for determining a rotation of the device based at least in part on the plurality of first navigational measurements and the plurality of second navigational measurements; and means for controlling a print head to deposit a printing substance on a medium based at least in part on the received image, the determined translation, and the determined rotation.

The means for determining the rotation may include means for accumulating first incremental translational changes between successive navigational measurements of the plurality of first navigational measurements; means for accumulating second incremental translational changes between successive navigational measurements of the plurality of second navigational measurements; and means for comparing the first accumulated incremental translational changes to the second accumulated incremental translational changes.

Other features that are considered as characteristic for embodiments of the present invention are set forth in the appended claims.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C). The phrase "(A) B" means (A B) or (B), that is, A is optional.

Figure 1:
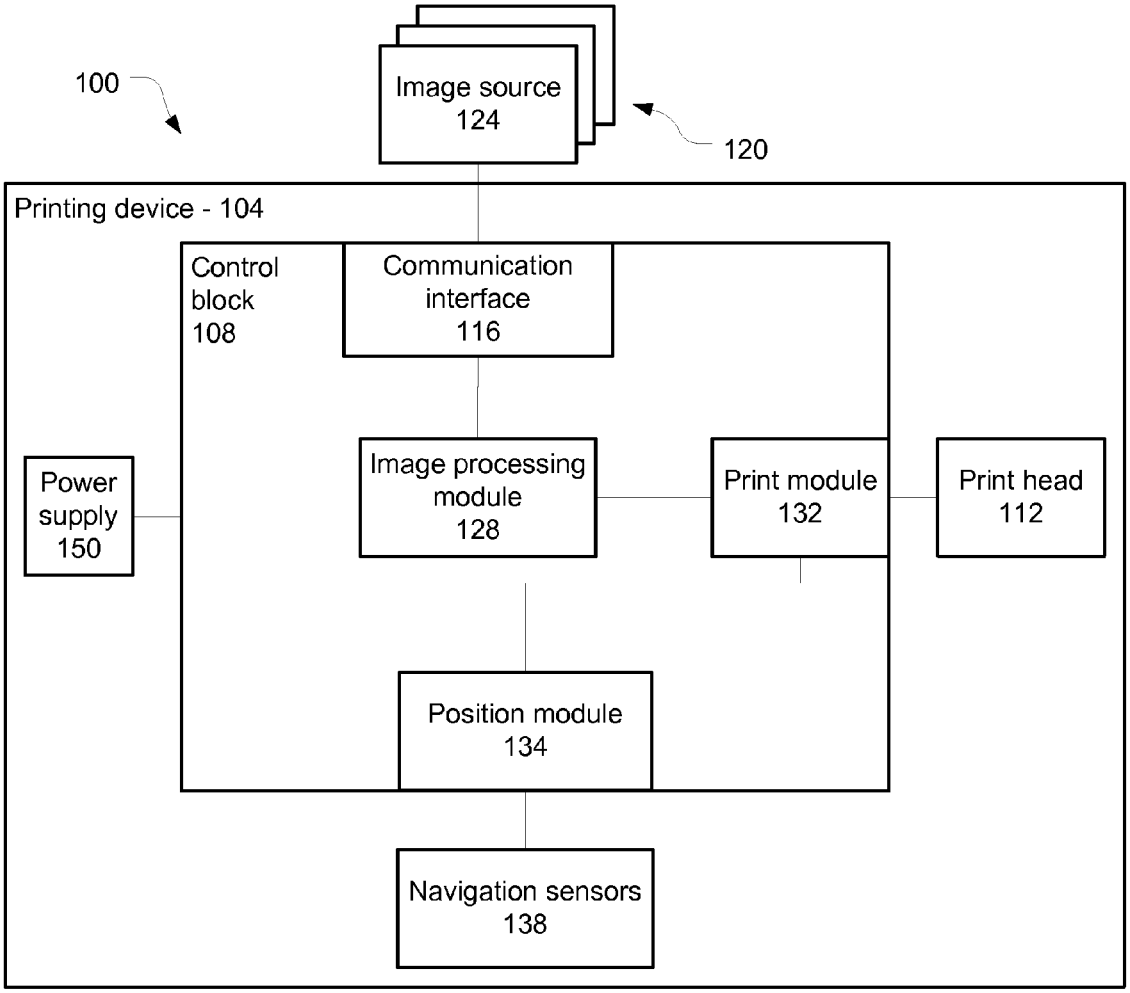
FIG. 1 is a schematic of a system including a handheld image translation device in accordance with various embodiments of the present invention.

FIG. 1 is a schematic of a system 100 including a handheld image translation (IT) device 104 in accordance with various embodiments of the present invention. The IT device 104 may include a control block 108 with components designed to facilitate precise and accurate positioning of input/output (I/O) components 112 throughout an entire IT operation. This positioning may allow the IT device 104 to reliably translate an image in a truly mobile and versatile platform as will be explained herein.

Image translation, as used herein, may refer to a translation of an image that exists in a particular context (e.g., medium) into an image in another context. For example, an IT operation may be a scan operation. In this situation, a target image, e.g., an image that exists on a tangible medium, is scanned by the IT device 104 and an acquired image that corresponds to the target image is created and stored in memory of the IT device 104. For another example, an IT operation may be a print operation. In this situation, an acquired image, e.g., an image as it exists in memory of the IT device 104, may be printed onto a medium.

The control block 108 may include a communication interface 116 configured to communicatively couple the control block 108 to an image transfer device 120. The image transfer device 120 may include any type of device capable of transmitting/receiving data related to an image, or image data, involved in an IT operation. The image transfer device 120 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If the image transfer device 120 is a removable storage device, e.g., a universal serial bus (USB) storage device, the communication interface 116 may be coupled to a port, e.g., USB port, of the IT device 104 designed to receive the storage device.

The communication interface 116 may include a wireless transceiver to allow the communicative coupling with the image transfer device 120 to take place over a wireless link. The image data may be wirelessly transmitted over the link through the modulation of electromagnetic waves with frequencies in the radio, infrared or microwave spectrums.

A wireless link may contribute to the mobility and versatility of the IT device 104. However, some embodiments may additionally/alternatively include a wired link communicatively coupling the image transfer device 120 to the communication interface 116.

In some embodiments, the communication interface 116 may communicate with the image transfer device 120 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth, Global System for Mobile Communications (GSM), code-division multiple access (CDMA), Ethernet, etc.

When the IT operation includes a print operation, the communication interface 116 may receive image data from the image transfer device 120 and transmit the received image data to an on-board image processing module 128. The image processing module 128 may process the received image data in a manner to facilitate an upcoming printing process. Image processing techniques may include dithering, decompression, half-toning, color plane separation, and/or image storage. In various embodiments some or all of these image processing operations may be performed by the image transfer device 120 or another device. The processed image may then be transmitted to an I/O module 132, which may function as a print module in this embodiment, where it is cached in anticipation of the print operation.

The I/O module 132, which may be configured to control the I/O components 112, may receive positioning information indicative of a position of a print head of the I/O components 112 relative to a reference location from a position module 134. The position module 134 may control one or more navigation sensors 138 to capture navigational measurements to track incremental movement of the IT device 104 relative to the reference location.

In some embodiments, the navigational measurements may be navigational images of a medium adjacent to the IT device 104. In these embodiments, the navigation sensors 138 may include one or more imaging navigation sensors. An imaging navigation sensor may include a light source, e.g., light-emitting diode (LED), a laser, etc., and an optoelectronic sensor designed to capture a series of navigational images of an adjacent medium as the IT device 104 is moved over the medium.

The position module 134 may process the navigational images to detect structural variations of the medium. The movement of the structural variations in successive images may indicate motion of the IT device 104 relative to the medium. Tracking this relative movement may facilitate determination of the precise positioning of the navigation sensors 138. The navigation sensors 138 may be maintained in a structurally rigid relationship with the I/O components 112, thereby allowing for the calculation of the precise location of the I/O components 112.

In other embodiments, non-imaging navigation sensors, e.g., an accelerometer, a gyroscope, a pressure sensor, etc., may be additionally/alternatively used to capture navigational measurements.

The navigation sensors 138 may have operating characteristics sufficient to track movement of the image translation device 104 with the desired degree of precision. In one example, imaging navigation sensors may process approximately 2000 frames per second, with each frame including a rectangular array of 30×30 pixels. Each pixel may detect a six-bit grayscale value, e.g., capable of sensing 64 different levels of patterning.

Once the I/O module 132 receives the positioning information it may coordinate the location of the print head to a portion of the processed image with a corresponding location. The print module may then control the print head in a manner to deposit a printing substance on the medium adjacent to the IT device 104 to represent the corresponding portion of the processed image.

The print head may be an inkjet print head having a plurality of nozzles designed to emit liquid ink droplets. The ink, which may be contained in reservoirs or cartridges, may be black and/or any of a number of various colors. A common, full-color inkjet print head may have nozzles for cyan, magenta, yellow, and black ink. Other embodiments may utilize other printing techniques, e.g., toner-based printers such as laser or LED printers, solid ink printers, dye-sublimation printers, inkless printers, etc.

In an embodiment in which an IT operation includes a scanning operation, the I/O module 132 may function as an image capture module and may be communicatively coupled to one or more optical imaging sensors of the I/O components 112. Optical imaging sensors, which may include a number of individual sensor elements, may be designed to capture a plurality of surface images of a medium adjacent to the IT device 104. The surface images may be individually referred to as component surface images. The I/O module 132 may generate a composite image by stitching together the component surface images. The I/O module 132 may receive positioning information from the position module 134 to facilitate the arrangement of the component surface images into the composite image.

Relative to the imaging navigation sensors, the optical imaging sensors may have a higher resolution, smaller pixel size, and/or higher light requirements. While the imaging navigation sensors are configured to capture details about the structure of the underlying medium, the optical imaging sensors may be configured to capture an image of the surface of the medium itself.

In an embodiment in which the IT device 104 is capable of scanning full color images, the optical imaging sensors may have sensor elements designed to scan different colors.

A composite image acquired by the IT device 104 may be subsequently transmitted to the image transfer device 120 by, e.g., e-mail, fax, file transfer protocols, etc. The composite image may be additionally/alternatively stored locally by the IT device 104 for subsequent review, transmittal, printing, etc.

In addition (or as an alternative) to composite image acquisition, an image capture module may be utilized for calibrating the position module 134. In various embodiments, the component surface images (whether individually, some group, or collectively as the composite image) may be compared to the processed print image rendered by the image processing module 128 to correct for accumulated positioning errors and/or to reorient the position module 134 in the event the position module 134 loses track of its reference point. This may occur, for example, if the IT device 104 is removed from the medium during an IT operation.

The IT device 104 may include a power supply 150 coupled to the control block 108. The power supply 150 may be a mobile power supply, e.g., a battery, a rechargeable battery, a solar power source, etc. In other embodiments the power supply 150 may additionally/alternatively regulate power provided by another component (e.g., the image transfer device 120, a power cord coupled to an alternating current (AC) outlet, etc.).

Figure 2:
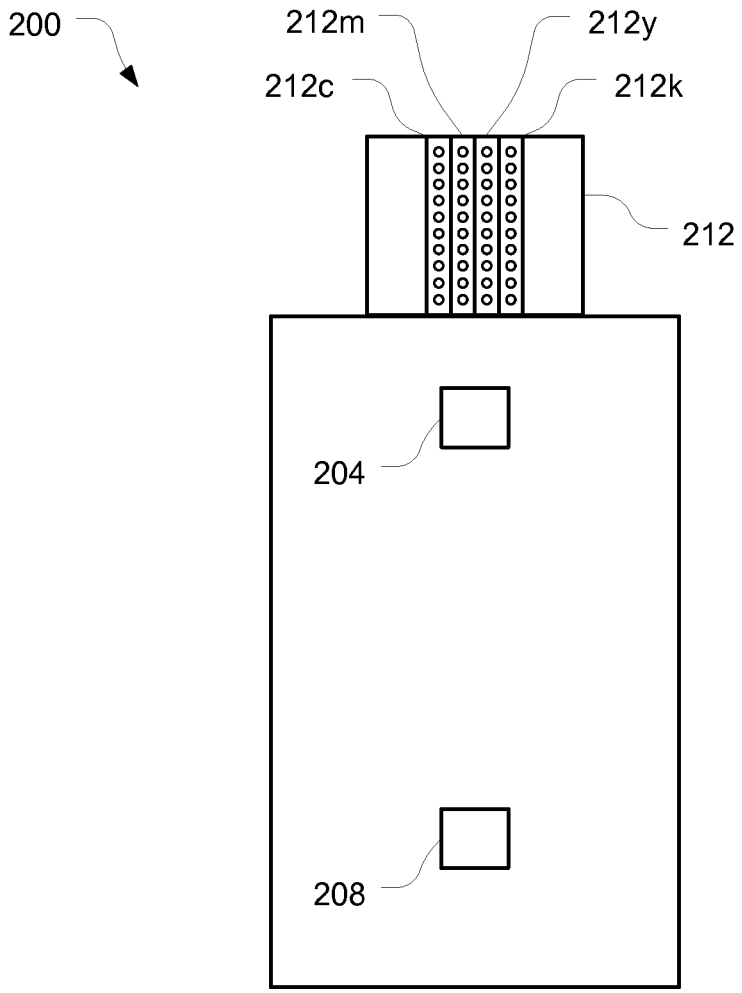
FIG. 2 is a bottom plan view of a handheld image translation device in accordance with various embodiments of the present invention.

FIG. 2 is a bottom plan view of an IT device 200 in accordance with various embodiments of the present invention. The IT device 200, which may be substantially interchangeable with IT device 104, may have a first navigation sensor 204, a second navigation sensor 208, and a print head 212.

The navigation sensors 204 and 208 may be used by a position module, e.g., position module 134, to determine positioning information related to the print head 212. As stated above, the proximal relationship of the print head 212 to the navigation sensors 204 and 208 may be fixed to facilitate the positioning of the print head 212 through information obtained by the navigation sensors 204 and 208.

The print head 212 may be an inkjet print head having a number of nozzle rows for different colored inks. In particular, and as shown in FIG. 2, the print head 212 may have a nozzle row 212*c* for cyan-colored ink, a nozzle row 212*m* for magenta-colored ink, a nozzle row 212*y* for yellow-colored ink, and nozzle row 212*k* for black-colored ink.

While the nozzle rows 212*c*, 212*m*, 212*y*, and 212*k* shown in FIG. 2 are arranged in rows according to their color, other embodiments may intermix the different colored nozzles in a manner that may increase the chances that an adequate amount of appropriate colored ink is deposited on the medium through the natural course of movement of the IT device 200 over the medium.

In another embodiment, the IT device 200 may include optical imaging sensors adjacent to the nozzle rows.

Figure 3:
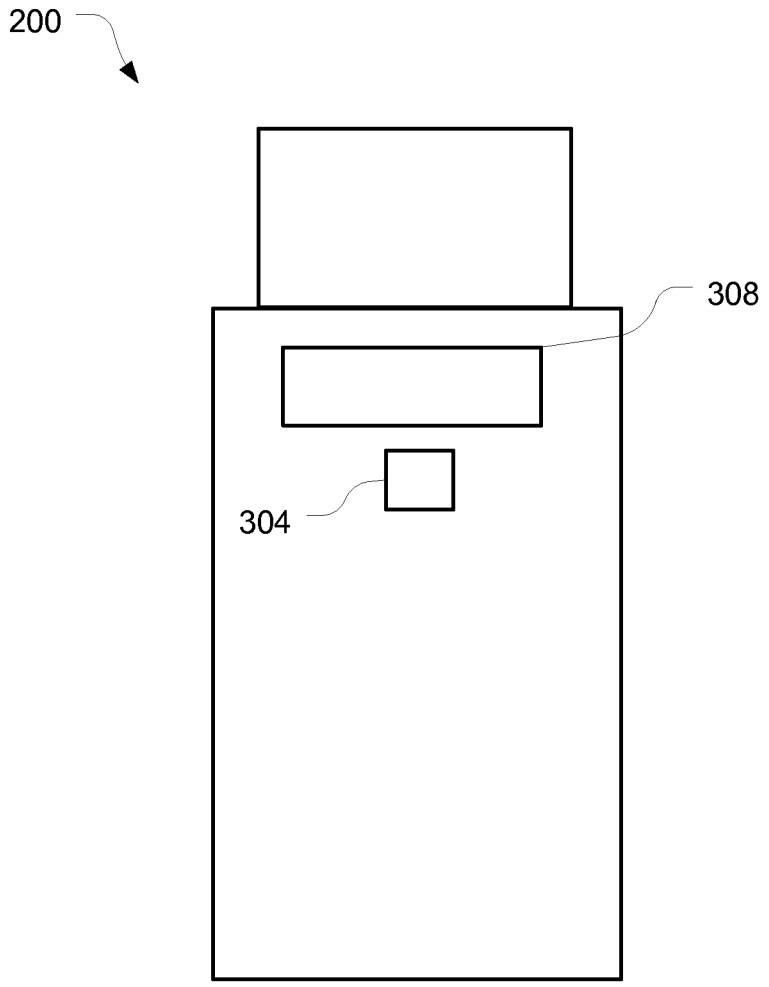
FIG. 3 is a top plan view of a handheld image translation device in accordance with various embodiments of the present invention.

FIG. 3 is a top plan view of the IT device 200 in accordance with various embodiments of the present invention. The IT device 200 may have a variety of user input/outputs to provide the functionality enabled through use of the IT device 200. Some examples of input/outputs that may be used to provide some of the basic functions of the IT device 200 include, but are not limited to, an IT control input 304 to initiate/resume a print and/or scan operation and a display 308.

The display 308, which may be a passive display, an interactive display, etc., may provide the user with a variety of information. The information may relate to the current operating status of the IT device 200 (e.g., printing, scanning, ready to print, ready to scan, receiving image data, transmitting image data, etc.), power of the battery, errors (e.g., positioning/printing/scanning error, etc.), instructions (e.g., "place IT device on medium prior to initiating IT operation," etc.). If the display 308 is an interactive display it may provide a control interface in addition to, or as an alternative from, the IT control input 304.

Figure 4:
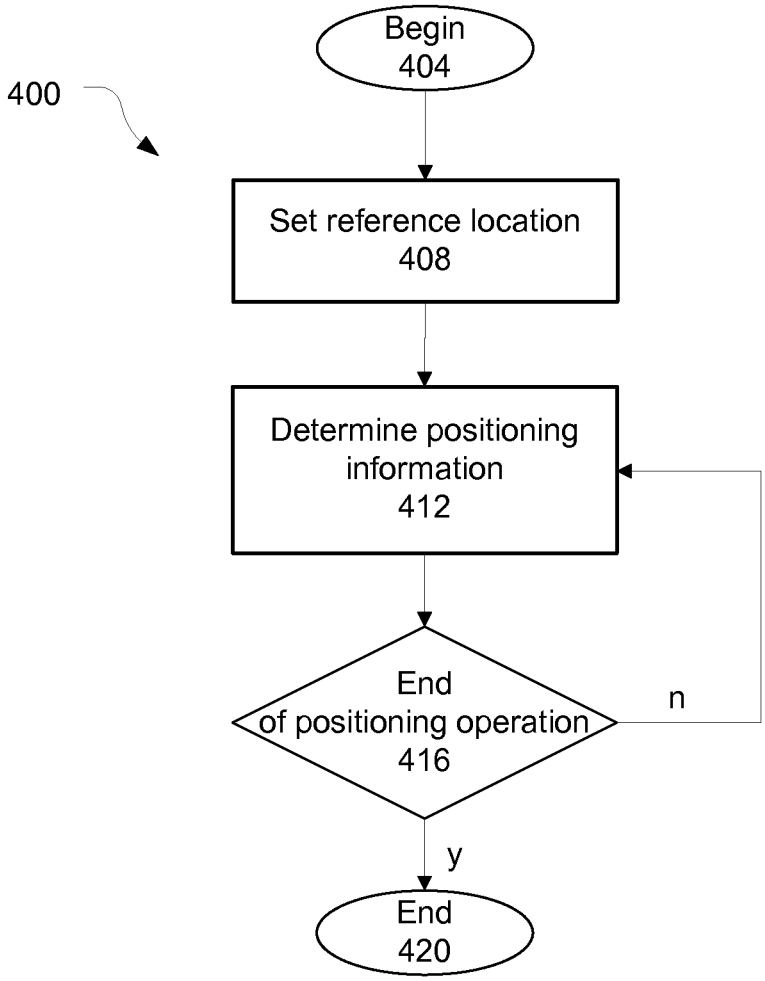
FIG. 4 is a flow diagram depicting a positioning operation of a handheld image translation device in accordance with various embodiments of the present invention.

FIG. 4 is a flow diagram 400 depicting a positioning operation of the IT device 200 in accordance with various embodiments of the present invention. A positioning operation may begin at block 404 with an initiation of a printing operation, e.g., by activation of the IT control input 304. A position module within the IT device 200 may set a reference location at block 408. The reference location may be set when the IT device 200 is placed onto a medium at the beginning of an IT operation. This may be ensured by the user being instructed to activate the IT control input 304 once the IT device 200 is in place and/or by the proper placement of the IT device 200 being treated as a condition precedent to instituting the positioning operation. In some embodiments the proper placement of the IT device 200 may be automatically determined through the navigation sensors 204 and/or 208 and/or some other sensors (e.g., a proximity sensor).

Once the reference location is set at block 408, the position module may determine positioning information, e.g., translational and rotational changes from the reference location, using the navigation sensors 204 and 208, and transmit the determined positioning information to an I/O module at block 412. The translational changes may be determined by tracking incremental changes of the positions of a navigation sensor along a two-dimensional coordinate system, e.g., $\Delta x$ and $\Delta y$. Rotational changes may refer to changes in the angle of the IT device 200, e.g., $\Delta\Theta$, with respect to, e.g., the y-axis. These transitional and/or rotational changes may be determined by the position module comparing consecutive navigational measurements taken by the navigation sensors 204 and 208 to detect these movements. This process may be further explained by reference to FIG. 5 and corresponding discussion.

While embodiments of the present invention discuss tracking an IT device in a two-dimensional coordinate system, other embodiments may include tracking within a three-dimensional coordinate system.

Figure 5:
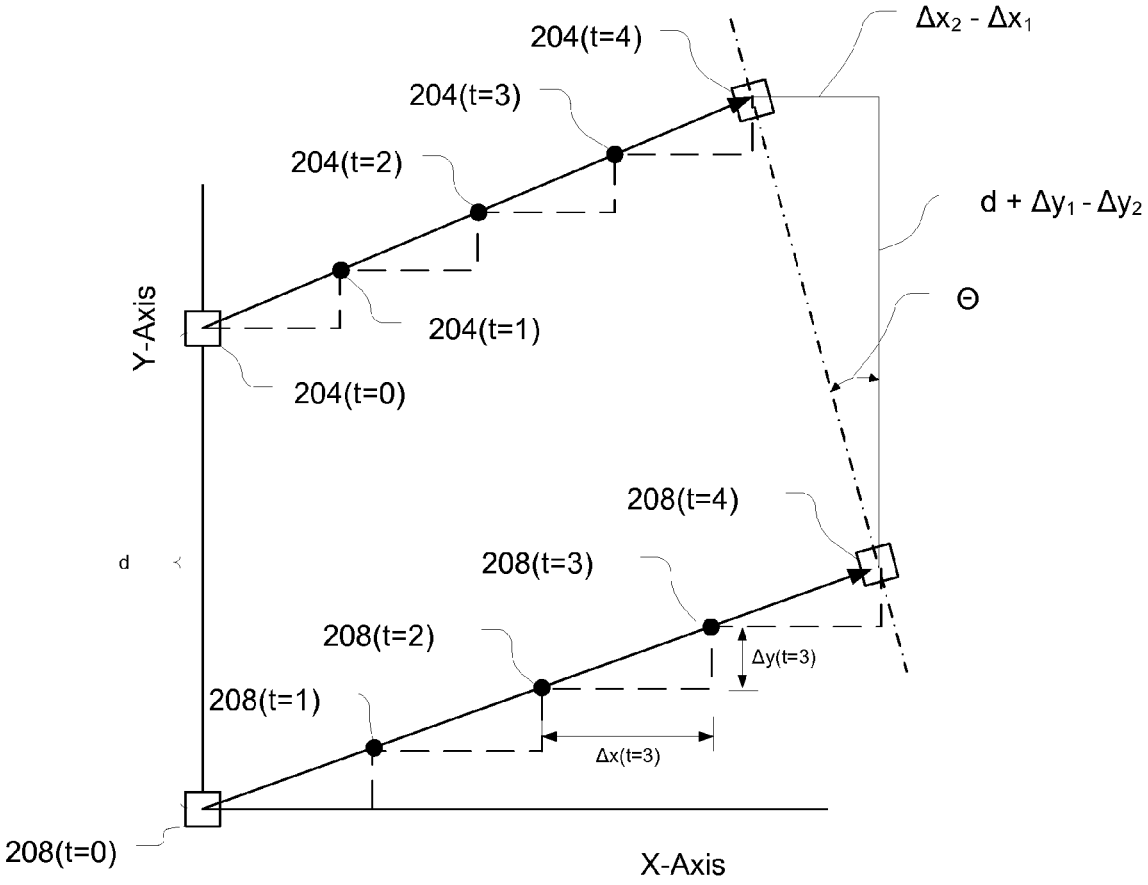
FIG. 5 is a graphic depiction of a positioning operation of a handheld image translation device in accordance with various embodiments of the present invention.

FIG. 5 is a graphic depiction of a positioning operation of the IT device 200 in accordance with embodiments of the present invention. At initiation, e.g., t=0, the sensors 204 and 208 may be in an initial position indicated by 204 (t=0) and 208 (t=0), respectively. Over successive time intervals, e.g., t=1-4, the sensors 204 and 208 may be moved to an end position indicated by 204 (t=4) and 208 (t=4), respectively. As used in description of this embodiment, the "initial position" and the "end position" are used merely with reference to this particular operation and not necessarily the start or end of the printing operation or even other positioning operations.

As the sensors 204 and 208 are moved, they may capture navigational measurements at each of the indicated time intervals, e.g., t=0-4. The capture period may be synchronized between the sensors 204 and 208 by, e.g., hardwiring together the capture signals transmitted from the position module. The capture periods may vary and may be determined based on set time periods, detected motion, or some other trigger. In some embodiments, each of the sensors 204 and 208 may have different capture periods that may or may not be based on different triggers.

The captured navigational measurements may be used by the position module to determine a translation of the IT device 200 relative to a reference location, e.g., the sensors 204 (t=0) and 208 (t=0) as well as a rotation of the IT device 200. In some embodiments, the translation of the device 200 may be determined by analyzing navigational measurements from a first sensor, e.g., sensor 204, while the rotation of the device 200 may be determined by analyzing navigational measurements from a second sensor, e.g., sensor 208. In particular, and in accordance with some embodiments, the rotation of the IT device 200 may be determined by comparing translation information derived from the navigational measurements provided by sensor 208 to translation information derived from navigational measurements provided by sensor 204. Determining both the translation and the rotation of the IT device 200 may allow the accurate positioning of all of the nozzles of the print head 212.

The translation of the sensors 204 and 208 may be determined within the context of a world-space (w-s) coordinate system, e.g., a Cartesian coordinate system. In particular, the translation values may be determined for two-dimensions of the w-s coordinate system, e.g., the x-axis and the y-axis as shown in FIG. 5. For example, the position module may accumulate the incremental $\Delta x$'s and $\Delta y$'s between successive time periods in order to determine the total translation of the sensors 204 and 208 from time zero to time four. The accumulated changes for sensor 204 may be referred to as $\Delta x_1$ and $\Delta y_1$ and the accumulated changes for sensor 208 may be referred to as $\Delta x_1$ and $\Delta y_2$. The sensors 204 and 208 may be a distance d from one another. The rotation $\Theta$ of the IT device 200 may then be determined by the following equation:

$$\theta = \sin^{-1}\left(\frac{|\Delta x_2 - \Delta x_1|}{d}\right), \qquad \text{Eq. 1.}$$

In some embodiments, each of the sensors 204 and 208 may report incremental delta values within their respective coordinate systems, which may then be mapped to the w-s coordinate system to provide the w-s translation and/or rotation values.

As can be seen from Eq. 1, the rotation $\Theta$ is derived in part by providing the distance d in the denominator of the arcsin value. Accordingly, a large distance d may provide a more accurate determination of the rotation $\Theta$ for a given sensor resolution. Therefore, in designing the IT device 200, the distance d may be established based at least in part on the resolution of the data output from the sensors 204 and 208. For example, if the sensors 204 and 208 have a resolution of approximately 1600 counts per inch, the distance d may be approximately two inches. In an embodiment having this sensor resolution and distance d, the rotation $\Theta$ may be reliably calculated down to approximately 0.0179 degrees.

While the embodiment shown in FIG. 2 illustrates the sensors 204 and 208 located on a first side of the print head 212, other configurations may be employed while still maintaining the desired distance d. For example, the sensors 204 and 208 may be on opposite sides of the print head 212. The configuration employed may be selected based on objectives of a particular embodiment. For example, disposing both sensors 204 and 208 on the same side of the print head 212 may limit the potential for ink contamination on the sensors 204 and 208 when printing and may allow more time for ink to dry on the medium before a second print pass is made in the same area, where the wet medium may induce more drag when the unit passes through the partially printed zone. In another example, placing the sensors 204 and 208 on opposite sides of the print head 212 may facilitate a detection of an edge of the medium.

Referring again to FIG. 4, following position determination at block 412, the position module may determine whether the positioning operation is complete at block 416. If it is determined that the positioning operation is not yet complete, the operation may loop back to block 412. If it is determined that it is the end of the positioning operation, the operation may end in block 420. The end of the positioning operation may be tied to the end of the printing operation, which will be discussed with reference to FIG. 6.

Figure 6:
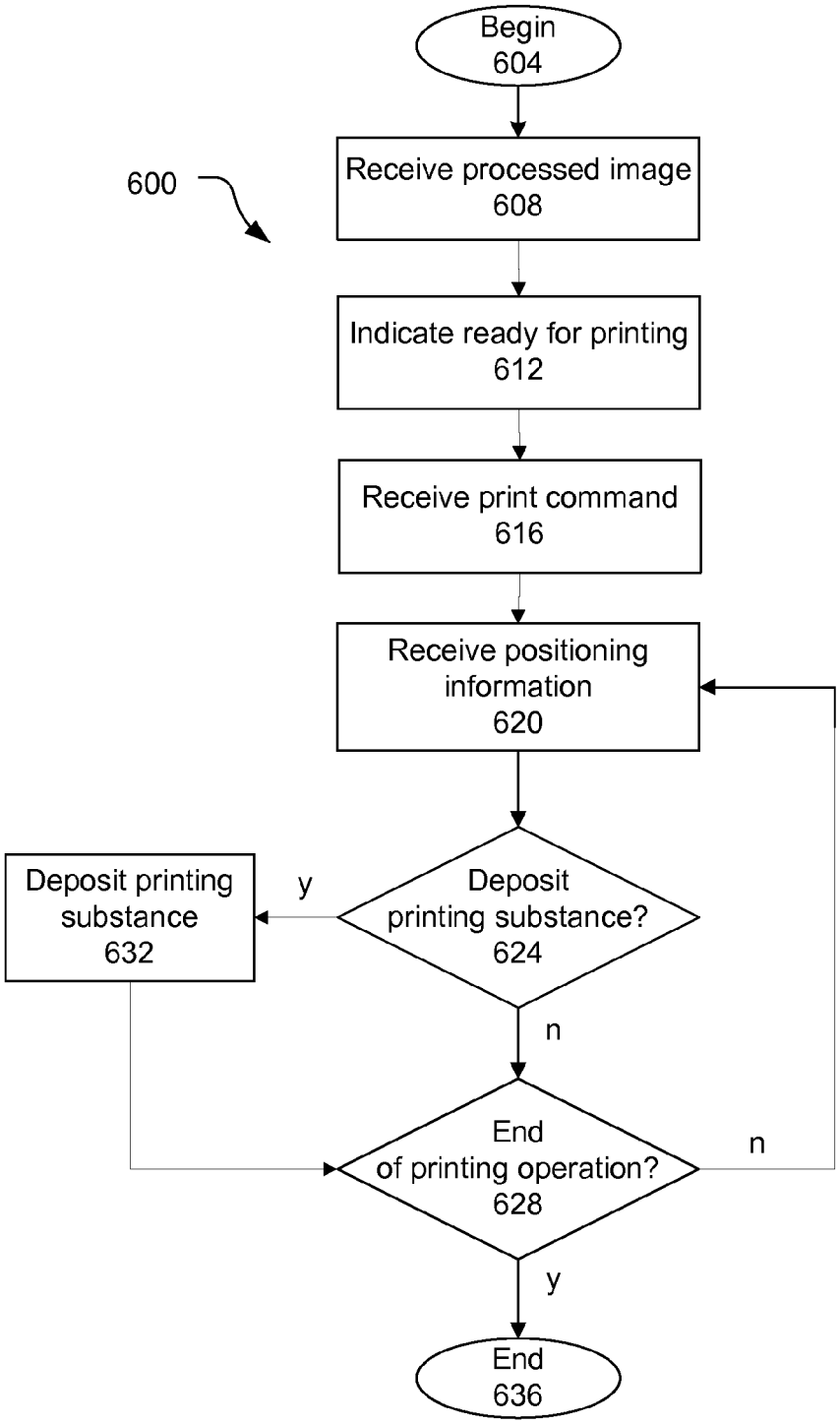
FIG. 6 is a flow diagram depicting a printing operation of a handheld image translation device in accordance with various embodiments of the present invention.

FIG. 6 is a flow diagram 600 depicting a printing operation of the IT device 200 in accordance with various embodiments of the present invention. The printing operation may begin at block 604. The print module may receive a processed image from the image processing module at block 608. Upon receipt of the processed image, the display 308 may indicate that the IT device 200 is ready for printing at block 612.

The print module may receive a print command generated from a user activating the IT control input 304 at block 616. The print module may then receive positioning information from the position module at block 620. The print module may then determine whether to deposit printing substance at the given position at block 624. The determination as to whether to deposit printing substance may be a function of the total drop volume for a given location and the amount of volume that has been previously deposited.

If it is determined that no additional printing substance is to be deposited at block 624, the operation may advance to block 628 to determine whether the end of the print operation has been reached. If it is determined that additional printing substance is to be deposited at block 624, the print module may cause an appropriate amount of printing substance to be deposited at block 632 by generating and transmitting control signals to the print head that cause the nozzles to drop the printing substance.

As can be seen, the position module's determination of the translation and rotation of the IT device 200 is done prior to the print module controlling the print head to deposit a printing substance. In order for the positioning information to remain relevant to the print determination, it may be desirable that the determination of the positioning information may take place as soon as possible after the acquisition of the navigational measurements upon which it is based. Accordingly, the translation and rotation calculations may be done in real time based on data accumulated up to that point. The rotation calculations are not determined retroactively based on a comprehensive accumulation of translation and image data as is done in prior art scanning devices discussed above.

The determination of whether the end of the printing operation has been reached at block 628 may be a function of the total printed volume versus the total anticipated print volume. In some embodiments the end of the printing operation may be reached even if the total printed volume is less than the total anticipated print volume. For example, an embodiment may consider the end of the printing operation to occur when the total printed volume is ninety-five percent of the total anticipated print volume. However, it may be that the distribution of the remaining volume is also considered in the end of print analysis. For example, if the five percent remaining volume is distributed over a relatively small area, the printing operation may not be considered to be completed.

In some embodiments, an end of print job may be established by a user manually cancelling the operation.

If, at block 628, it is determined that the printing operation has been completed, the printing operation may conclude at block 636.

If, at block 628, it is determined that the printing operation has not been completed, the printing operation may loop back to block 620.

Figure 7:
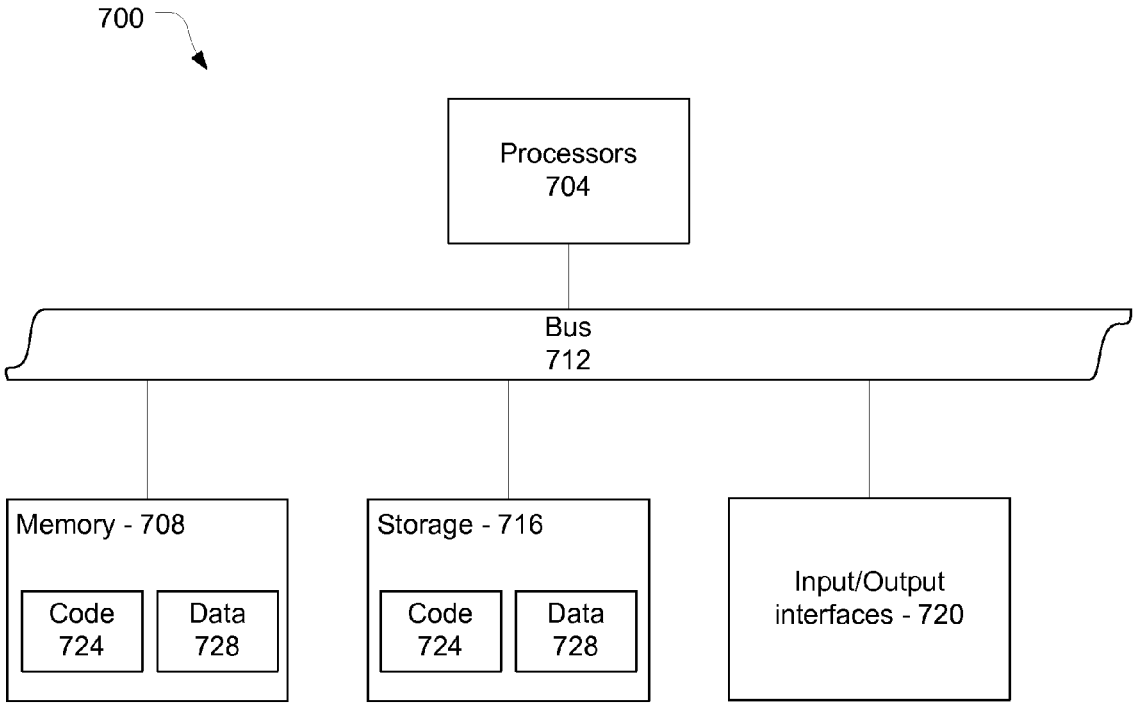
FIG. 7 illustrates a computing device capable of implementing a control block of a handheld image translation device in accordance with various embodiments of the present invention.

FIG. 7 illustrates a computing device 700 capable of implementing a control block, e.g., control block 108, in accordance with various embodiments. As illustrated, for the embodiments, computing device 700 includes one or more processors 704, memory 708, and bus 712, coupled to each other as shown. Additionally, computing device 700 includes storage 716, and one or more input/output interfaces 720 coupled to each other, and the earlier described elements as shown. The components of the computing device 700 may be designed to provide the printing and/or positioning functions of a control block of an IT device as described herein.

Memory 708 and storage 716 may include, in particular, temporal and persistent copies of code 724 and data 728, respectively. The code 724 may include instructions that when accessed by the processors 704 result in the computing device 700 performing operations as described in conjunction with various modules of the control block in accordance with embodiments of this invention. The processing data 728 may include data to be acted upon by the instructions of the code 724. In particular, the accessing of the code 724 and data 728 by the processors 704 may facilitate printing and/or positioning operations as described herein.

The processors 704 may include one or more single-core processors, multiple-core processors, controllers, application-specific integrated circuits (ASICs), etc.

The memory 708 may include random access memory (RAM), dynamic RAM (DRAM), static RAM (SRAM), synchronous DRAM (SDRAM), dual-data rate RAM (DDRRAM), etc.

The storage 716 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 716 may be a storage resource physically part of the computing device 700 or it may be accessible by, but not necessarily a part of, the computing device 700. For example, the storage 716 may be accessed by the computing device 700 over a network.

The I/O interfaces 720 may include interfaces designed to communicate with peripheral hardware, e.g., I/O components 112, navigation sensors 138, etc., and/or remote devices, e.g., image transfer device 120.

In various embodiments, computing device 700 may have more or less elements and/or different architectures.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. A handheld image translation device comprising:

a communication interface configured to receive an image from an image source;

a first navigation sensor and a second navigation sensor;

a position module configured to control (i) the first navigation sensor to capture a plurality of first navigational measurements and (ii) the second navigation sensor to capture a plurality of second navigational measurements, accumulate (i) first incremental translational changes between successive navigational measurements of the plurality of first navigational measurements and (ii) second incremental translational changes among successive navigational measurements of the plurality of second navigational measurements, determine a difference between (i) the accumulated first incremental translational changes and (ii) the accumulated second incremental translational changes, and determine a rotation of the handheld image translation device relative to a reference location based at least in part on the difference between (i) the accumulated first incremental translational changes and (ii) the accumulated second incremental translational changes; and a print module configured to cause a printing substance to be deposited on a medium based at least in part on (i) the image and (ii) the determined rotation of the handheld image translation device relative to the reference location.

2. The handheld image translation device of claim 1, wherein the position module is further configured to:

determine a ratio of (i) the difference between the accumulated first incremental translational changes and the accumulated second incremental translational changes and (ii) a distance between the first navigation sensor and the second navigation sensor; and determine the rotation of the handheld image translation device based at least in part on the determined ratio.

3. The handheld image translation device of claim 2, wherein the position module is further configured to:

determine the rotation of the handheld image translation device based at least in part on an arcsine of the determined ratio.

4. The handheld image translation device of claim 1, wherein the first incremental translational changes comprise changes in a first coordinate value.

5. The handheld image translation device of claim 1, wherein the position module is further configured to determine a translation of the handheld image translation device relative to the reference location, based at least in part on the plurality of first navigational measurements.

6. The handheld image translation device of claim 5, wherein:

the position module is further configured to determine a position of a print head of the handheld image translation device based at least in part on the determined (i) rotation of the handheld image translation device relative to the reference location and (ii) translation of the handheld image translation relative to the reference location; and the print module is further configured to cause the printing substance to be deposited on the medium based at least in part on the determined position of the print head.

7. The handheld image translation device of claim 1, wherein the position module is further configured to establish the reference location based at least in part on proximity of the handheld image translation device to the medium.

8. A method comprising:

receiving an image from an image source;

capturing (i) a plurality of first navigational measurements and (ii) a plurality of second navigational measurements;

accumulating (i) first incremental translational changes between successive navigational measurements of the plurality of first navigational measurements and (ii) second incremental translational changes between successive navigational measurements of the plurality of second navigational measurements;

determining a difference between (i) the accumulated first incremental translational changes and (ii) the accumulated second incremental translational changes;

determining a rotation of a handheld image translation device relative to a reference location based at least in part on the difference between (i) the accumulated first incremental translational changes and (ii) the accumulated second incremental translational changes; and depositing a printing substance on a medium based at least in part on (i) the received image and (ii) the determined rotation of the handheld image translation device relative to the reference location.

9. The method of claim 8, wherein determining the rotation of the handheld image translation device further comprises:

determining a ratio of (i) the difference between the accumulated first incremental translational changes and the accumulated second incremental translational changes and (ii) a distance between the first navigation sensor and the second navigation sensor; and determining the rotation of the handheld image translation device based at least in part on the determined ratio.

10. The method of claim 9, wherein determining the rotation of the handheld image translation device further comprises:

determining the rotation of the handheld image translation device based at least in part on an arcsine of the determined ratio.

11. The method of claim 8, wherein the first incremental translational changes comprise changes in a first coordinate value.

12. The method of claim 8, further comprising:

determining a translation of the handheld image translation device relative to the reference location based at least in part on the plurality of first navigational measurements.

13. The method of claim 12, further comprising:

determining a position of a print head of the handheld image translation device based at least in part on the determined (i) rotation of the handheld image translation device relative to the reference location and (ii) translation of the handheld image translation relative to the reference location.

14. The method of claim 12, wherein depositing the printing substance on the medium further comprises:

depositing a printing substance on a medium based at least in part on the determined translation of the handheld image translation device relative to the reference location.

15. A machine-accessible medium having associated instructions, which, when executed results in a handheld image translation device:

receiving an image from an image source;

capturing (i) a plurality of first navigational measurements and (ii) a plurality of second navigational measurements;

accumulating (i) first incremental translational changes between successive navigational measurements of the plurality of first navigational measurements and (ii) second incremental translational changes between successive navigational measurements of the plurality of second navigational measurements;

determining a difference between (i) the accumulated first incremental translational changes and (ii) the accumulated second incremental translational changes;

determining a rotation of a handheld image translation device relative to a reference location based at least in part on the difference between (i) the accumulated first incremental translational changes and (ii) the accumulated second incremental translational changes; and depositing a printing substance on a medium based at least in part on (i) the received image and (ii) the determined rotation of the handheld image translation device relative to the reference location.

16. The machine-accessible medium of claim 15, wherein the associated instructions, when executed further results in the handheld image translation device determining the rotation of the handheld image translation device relative to the reference location by:

determining a ratio of (i) the difference between the accumulated first incremental translational changes and the accumulated second incremental translational changes and (ii) a distance between the first navigation sensor and the second navigation sensor; and determining the rotation of the handheld image translation device based at least in part on the determined ratio.

17. The machine-accessible medium of claim 16, wherein the associated instructions, when executed further results in the handheld image translation device determining the rotation of the handheld image translation device relative to the reference location by:

determining the rotation of the handheld image translation device based at least in part on an arcsine of the determined ratio.

18. The machine-accessible medium of claim 15, wherein the associated instructions, when executed further results in the handheld image translation device:

determining a translation of the handheld image translation device relative to the reference location based at least in part on the plurality of first navigational measurements.

19. The machine-accessible medium of claim 15, wherein the associated instructions, when executed further results in the handheld image translation device:

determining a position of a print head of the handheld image translation device based at least in part on the determined (i) rotation of the handheld image translation device relative to the reference location and (ii) translation of the handheld image translation relative to the reference location.

20. The machine-accessible medium of claim 15, wherein the associated instructions, when executed further results in the handheld image translation device:

depositing a printing substance on a medium based at least in part on the determined translation of the handheld image translation device relative to the reference location.

* * * * *